US007517427B2

(12) United States Patent
Sjoberg et al.

(10) Patent No.: US 7,517,427 B2
(45) **Date of Patent: *Apr. 14, 2009**

(54) PROCESS FOR SEALING OF A JOINT

(75) Inventors: Ake Sjoberg, Lund (SE); Sven Kornfalt, Malmo (SE)

(73) Assignee: Pergo (Europe) AB, Trelleborg (SE)

( * ) Notice: Subject to any disclaimer, the term of this patent is extended or adjusted under 35 U.S.C. 154(b) by 107 days.

This patent is subject to a terminal disclaimer.

(21) Appl. No.: 11/389,169

(22) Filed: Mar. 27, 2006

(65) Prior Publication Data

US 2006/0165940 A1 Jul. 27, 2006

Related U.S. Application Data

(63) Continuation of application No. 10/725,932, filed on Dec. 3, 2003, now Pat. No. 7,029,741.

(30) Foreign Application Priority Data

Dec. 9, 2002 (SE) ..... 0203631

(51) Int. Cl.
*B29C 65/54* (2006.01)
*E04F 15/04* (2006.01)

(52) U.S. Cl. ..... 156/304.5; 156/71; 52/592.1; 52/592.4

(58) Field of Classification Search ..... 156/71, 156/304.5; 52/592.1, 592.4
See application file for complete search history.

(56) References Cited

U.S. PATENT DOCUMENTS 6,421,970 B1 7/2002 Martensson et al.
6,606,834 B2 8/2003 Martensson et al.
6,647,690 B1 * 11/2003 Martensson ..... 52/601
6,804,926 B1 * 10/2004 Eisermann ..... 52/592.1
7,029,741 B2 * 4/2006 Sjoberg et al. ..... 428/60
7,037,024 B2 * 5/2006 Steinwender ..... 403/267
2002/0046526 A1 4/2002 Knauseder
2002/0127374 A1 9/2002 Spratling
2002/0148551 A1 10/2002 Knauseder (Continued)

FOREIGN PATENT DOCUMENTS

DE 29703962 6/1997

(Continued)

OTHER PUBLICATIONS

U.S. Appl. No. 10/158,945.

(Continued)

*Primary Examiner*—Mark A Osele
(74) *Attorney, Agent, or Firm*—Novak Druce & Quigg LLP

(57) ABSTRACT

Means for installation of panels, the panels comprising a core, a decorative upper surface and edges provided with joining means for positioning the panels towards one another. Predetermined portions of the edges are provided with an encapsulated agent which is made present on the edges of the surface elements before assembly and which encapsulation is ruptured by means of assembly making the agent available to the core. The surface elements are hereby joined to one another by use of the joining means wherein a unit of a plurality of surface elements is formed.

13 Claims, 2 Drawing Sheets

U.S. PATENT DOCUMENTS

| | | | |
|---|---|---|---|
| 2002/0189747 | A1 | 12/2002 | Steinwender |
| 2004/0031226 | A1 | 2/2004 | Miller et al. |
| 2004/0031227 | A1 | 2/2004 | Knauseder |
| 2004/0041225 | A1 | 3/2004 | Nemoto |

FOREIGN PATENT DOCUMENTS

| | | | |
|---|---|---|---|
| DE | 19821938 | | 11/1999 |
| DE | 19933343 | A1 * | 2/2001 |
| DE | 10131248 | | 1/2003 |
| EP | 1229181 | | 8/2002 |
| EP | 1229182 | | 8/2002 |
| WO | 03093686 | | 11/2003 |

OTHER PUBLICATIONS

U.S. Appl. No. 10/228,065.

* cited by examiner

PROCESS FOR SEALING OF A JOINT

CROSS-REFERENCE TO RELATED APPLICATIONS

This application is a continuation of U.S. application Ser. No. 10/725,932, filed Dec. 3, 2003, now U.S. Pat. No. 7,029,741, which claims priority from SE0203631-7filed Dec. 9, 2002, each of which is hereby incorporated by reference in its entirety.

The present invention relates to sealing of a joint comprising glued edges.

Prefabricated surface elements which at their edges are provided with groove and tenon are well known nowadays. As these are very easy to install, it is possible for the normal handy man to achieve this. Such elements can be constituted of massive wood, fibre board or particle board. These are often provided with a surface layer, such as lacquer or some sort of laminate. The boards are most often installed by gluing them together via their groove and tenon. It is desired to join the separate elements so closely that the joint becomes practically invisible, which increases the moisture resistance radically. The usable life of the installed elements are hereby also increased. It is essential that glue is used excessively in order to achieve a tight joint. Any gaps will make it possible for moisture to penetrate the joint with subsequent swelling of the core material closest to the joint. The glue also have to be used to an amount that it is spill out trough the joint on the decorative side of the surface elements. The superfluous glue will of course have to be wiped off before beginning to set, which is very time consuming.

One way of solving the problem is available on the market for some time now through different types of so-called click or snap-lock floor boards where no glue is to be used. The installation of such floor boards has become much swifter as no glue is required. The problems with these type of surface elements are that relatively small spills of fluids like water may cause great damage on the installed surface elements as well as sub walls and especially subfloors as the fluid will run through the joints rather rapidly due to the capillary effect. It is, of course, possible to use glue on these snap-lock type of elements as well although the problem with the time consuming cleaning during installation would remain.

It has, through the present invention, been made possible to solve the above mentioned problems so that self sealing surface elements can be achieved. The glue system can be used on any type of joint but have its greatest advantage on panels provided with tongue and grove along its edges. The glue system is advantageously used on joints with mechanical locking since a snap-action locking will ensure a proper positioning with radically decreased risk for undesired gaps in the joint. Accordingly the invention relates to a means for installation of panels. The panels comprises a core, a decorative upper surface and edges provided with joining means for positioning the panels towards one another. The invention is characterised in that predetermined portions of the edges are provided with an encapsulated agent which is made present on the edges of the surface elements before assembly and which encapsulation is ruptured by means of the assembly making the agent available to the core. The panels are hereby joined to each other by use of the joining means wherein a unit of a plurality of surface elements is formed.

According to one embodiment of the invention the encapsulated agent is present in the form of at least one tube containing the agent. Such a tube is then preferably sealed in its ends, thereby preventing the agent to leak.

According to a preferred embodiment of the invention the tube is sectioned into a series of confined bodies of agent. This will ensure that enough of the agent is present to ensure a good bond when cutting panels during installation, as such cutting, inevitably will rupture the tube. Since the tube is sectioned, only one or at most two of the confined bodies of agent will be ruptured, leaving enough of the confined bodies of agent to ensure a good bond. The most important reason to have the tube sectioned into confined bodies of agent is however the importance of even distribution of the agent along the joint. If, for example, a single compartment tube were to be used and the joint were assembled slowly, it would be possible that a full amount of the agent would leak out at one of its ends. This is, of course not desired. It is therefore advantageous to use a tube which is sectioned. It is also advantageous to design the tube in a way that it will rupture in a controlled manner during assembly. This is best performed by making the tube of a strip material, most suitably a thermoplastic laminate. The materials of the laminate are selected so that the longitudinal bond of the tube breaks before the latitudinal bond. It will hereby be secured that each body of agent will rupture during assembly. One way of achieving this is by making the tube welded from a thermoplastic laminate strip where the long sides of the strip is overlapping so that an inside of the strip is welded towards an outside of the opposite long side of the strip thereby forming the tube. The material of the laminate is selected so that the inside is constituted of a first material and the outside is constituted by a second material wherein the first material will have a good bond when welded together with itself and wherein a second material have a bond to the first material which is weaker than the bond between two first materials.

The encapsulated agent may cording to one embodiment of the invention be a glue, suitably of the poly vinyl acetate ("PVAC") glue type or a polyurethane glue type. The encapsulated agent may alternatively be a solvent used as an activator. A glue is then pre-applied on the edges as an emulsion which then is allowed to dry before the joining of the surface elements, whereby the agent is a solvent used for activating the dry glue during assembly. Both the pre-applied dry glue and the tube containing the agent is advantageously applied during manufacturing to make the final assembly easier. The pre-applied dry glue is suitably a PVAC glue whereby the agent is water or a mixture of water and alcohol. The glue may further comprise an expanding agent causing the glue to swell when activated. This will ensure that the glue is distributed over desired surfaces of the joint. Such an expanding agent may be a cellulose derivative. It is also possible to an expanding agent which reacts with water or alcohol like for example calcium hydro carbonate or sodium hydro carbonate. This will cause the glue to foam.

According to an alternative embodiment of the invention the agent is encapsulated glue which is present in the form of pairs of tubes where a first tube contains a first glue component of a two component glue system and where a second tube contains a second component of the two component glue system. Also here the tubes are preferably at least sealed in the ends. It is however most advantageous to have the tubes sectioned into a series of confined bodies of glue of reasons as discussed above.

The joining means of the panel according to the present invention are suitably arranged so that a first edge of the panel is provided with a groove while a second edge, arranged parallel to the first edge and opposite thereto, is provided with a tongue. The encapsulated agent is suitably applied in a recess in the groove. The encapsulated agent is alternatively applied in a recess on the tongue, suitably on an upper portion of the tongue. The joining means suitably comprises snapping wedges and recesses arranged to position and mechanically lock the panels tightly together while the glue sets. Also remaining edges of the panel is advantageously provided joining means and an encapsulated agent like described above.

According to an alternative embodiment of the invention the encapsulated agent is present in the form of a plurality of spheres containing the agent. The spheres may contain a glue or a solvent used for activating pre-applied glue as previously discussed in connection to the tube shaped encapsulation. Also here the encapsulated agent may be a glue contained in pairs of spheres where a first amount of spheres contains a first glue component of a two component glue system and where a second amount of spheres contains a second component of the two component glue system. The material used for making the spheres may be glass or a thermoplastic material, taking in consideration that it should be easily ruptured and be able to prevent the contents from migrating through the walls of the encapsulation for at least 3 months.

The invention is described further in connection to enclosed figures showing different embodiments of the invention whereby, FIG. 1 shows a first embodiment of adjacent edges of two panels to be joined according to the present invention.

Figure 1:
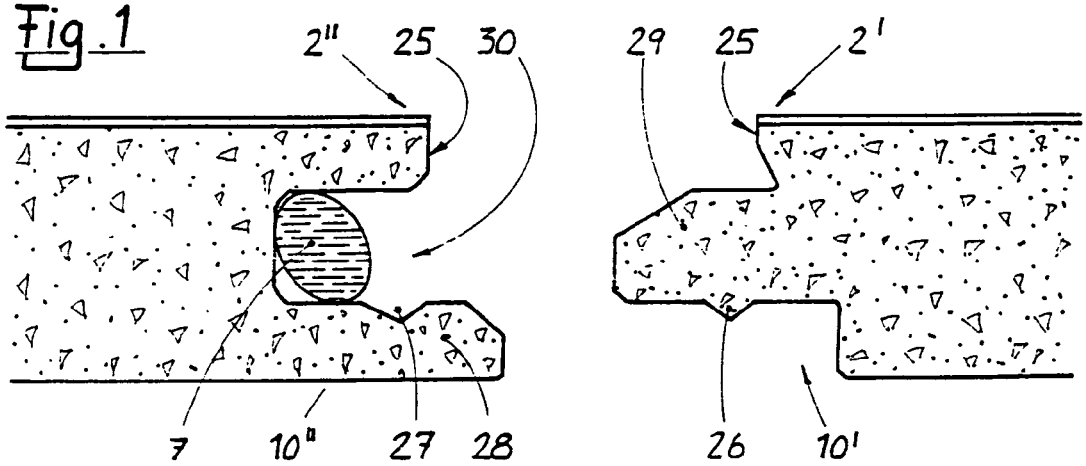

FIG. 1 shows, in cross-section, two adjacent edges according to a first embodiment of the invention. The panels 1 are provided with a first assembly joining member 10' on a first edge 2' while a second edge 2" is provided with a second assembly joining member 10". The second edge 2" is arranged on a side opposite to the first edge 2'. The first assembly joining member 10' is provided with a lower snapping web 26 arranged on the lower side of a tongue. The lower snapping web 26 is intended to interact with a recess 27 arranged on a lower cheek 28 arranged on the second vertical assembly joining members 10" so that two joined adjacent panels 1 are locked against each other in a horizontal direction. The lower cheek 28 forms a lower surface of a groove 30 in the second edge 2".

The joint between a first and a second edge 2' and 2" respectively of two joined panels 1 further comprises contact surfaces which are constituted by the lower snapping web 26 and recess 27, the tongue 29 and groove 30 as well as upper mating surfaces 25. The joint between two joined panels 1 also comprises cavities which are formed between the surfaces of the assembled joint. One such cavity is arranged between the upper mating surface 25 and the tongue 29 of the first assembly joining member 10'. One special cavity is formed in the bottom of the groove 30 and is designed for holding a tube of encapsulated PVAC glue. The special cavity as well as the tip of the tongue 29, being closest to the special cavity when assembled, is designed to rupture the tube of encapsulated glue 7 and force the glue towards the upper mating surfaces 25. The later may be further secured by having applied a foaming agent on the surface of the special cavity, or by using a polyurethane glue. The tip of the tongue 29 is further provided with an angled upper surface intended to guide the glue to the upper portions o the joint.

Figure 2:
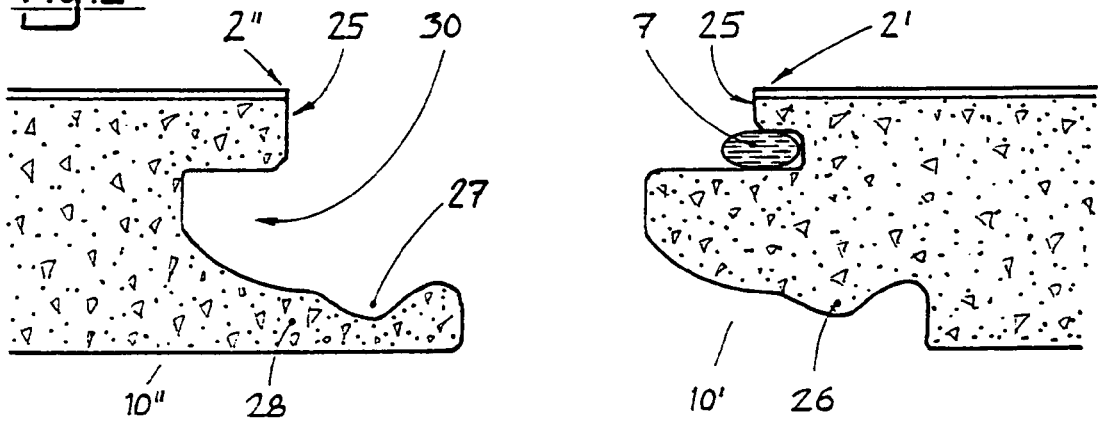
FIG. 2 shows a second embodiment of adjacent edges of two panels to be joined according to the present invention.

FIG. 2 shows, in cross-section, two adjacent edges according to a second embodiment of the invention. The panels 1 are provided with a first assembly joining member 10' on a first edge 2' while a second edge 2" is provided with a second assembly joining member 10". The second edge 2" is arranged on a side opposite to the first edge 2'. The first assembly joining member 10' is provided with a lower snapping web 26 arranged on the lower side of a tongue 29. The lower snapping web 26 is intended to interact with a recess 27 arranged on a lower cheek 28 arranged on the second vertical assembly joining members 10" so that two joined adjacent panels 1 are locked against each other in a horizontal direction. The lower cheek 28 forms a lower surface of a groove 30 in the second edge 2".

The joint between a first and a second edge 2' and 2" respectively of two joined panels 1 further comprises contact surfaces which are constituted by the lower snapping web 26 and recess 27, the tongue 29 and groove 30 as well as upper mating surfaces 25. The joint between two joined panels 1 also comprises cavities which are formed between the surfaces of the assembled joint. One special cavity is formed between the upper mating surface 25 and the tongue 29 of the first assembly joining member 10' and is designed for holding a tube of encapsulated PVAC glue. The special cavity as well as the opposite edge mating surface 25, being closest to the special cavity when assembled, is designed to rupture the tube of encapsulated glue 7. It is possible to further secure distribution of the glue by having applied a foaming agent on the surface of the special cavity, or by using a polyurethane glue with foaming agent. The tip of the tongue 29 is further provided with an angled upper surface intended to guide the glue to the upper portions of the joint.

Figure 3:
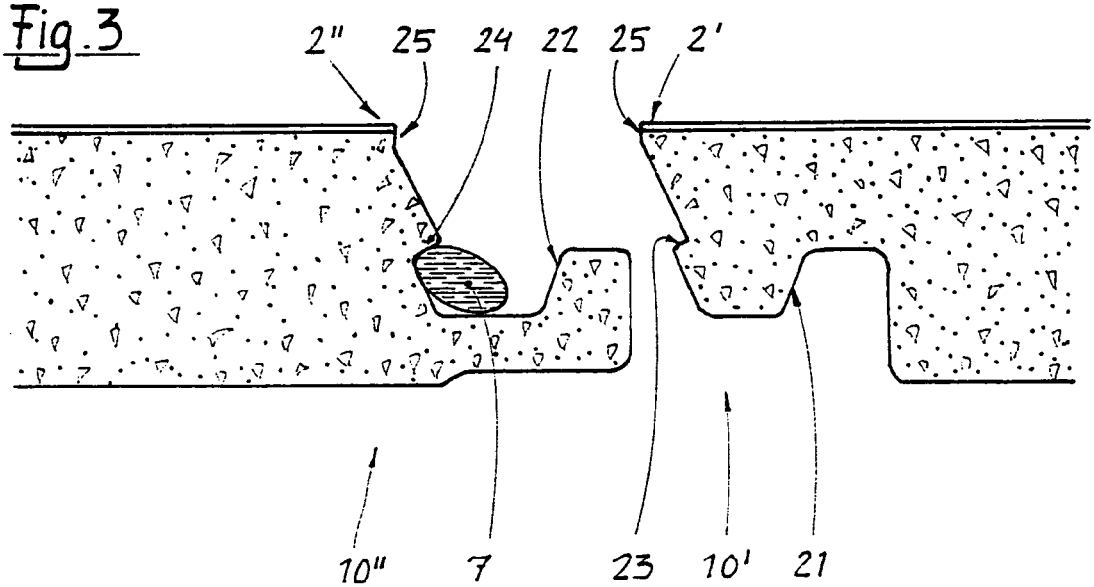
FIG. 3 shows a third embodiment of adjacent edges of two panels to be joined according to the present invention.

FIG. 3 shows, in cross-section, two adjacent edges according to a third embodiment of the invention. The panels 1 are provided with a first vertical assembly joining member 10' on a first edge 2' while a second edge 2" is provided with a second vertical assembly joining member 10". The second edge 2" is arranged on a side opposite to the first edge 2'. The first vertical assembly joining member 10' is provided with mainly vertical lower cheek surfaces 21 arranged parallel to the closest edge 2. The lower cheek surfaces 21 are intended to interact with mainly vertical upper cheek surfaces 22 arranged on the second vertical assembly joining members 10" so that two joined adjacent panels 1 are locked against each other in a horizontal direction. The first vertical assembly joining member 10' is moreover provided with a snapping hook 23 while the second vertical assembly joining member 10" is provided with a matching undercut 24, which by being provided with mainly horizontal locking surfaces limits the vertical movement between two joined adjacent panels 1.

The joint between a first and a second edge 2' and 2" respectively of two joined panels 1 further comprises contact surfaces which are constituted by the locking surfaces of the under cuts 23 and hooks 24, the mainly vertical upper cheek surfaces 22, lower cheek surfaces 21 as well as upper mating surfaces 25. The joint between two joined panels 1 also comprises cavities which are formed between the surfaces of the assembled joint. One special cavity is designed for holding a tube of encapsulated PVAC glue 7 is arranged below the under cut 23. The special cavity as well as the portion of the opposite edge 2 being closest to the special cavity when assembled, is designed to rupture the tube of encapsulated glue 7 and force the glue towards the upper mating surfaces 25. The later may be further secured by having applied a foaming agent on the surface of the special cavity, or by using a polyurethane glue.

Figure 4:
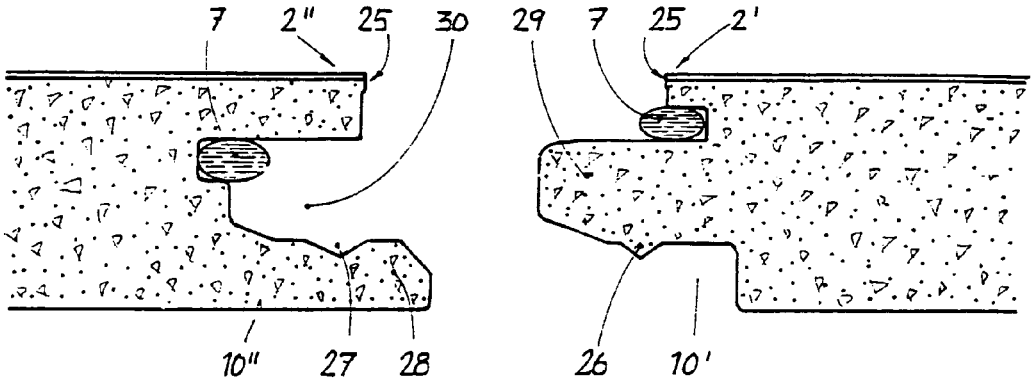
FIG. 4 shows a fourth embodiment of adjacent edges of two panels to be joined according to the present invention.

FIG. 4 shows, in cross-section, two adjacent edges according to a fourth embodiment of the invention. The panels 1 are provided with a first assembly joining member 10' on a first edge 2' while a second edge 2" is provided with a second assembly joining member 10". The second edge 2" is arranged on a side opposite to the first edge 2'. The first assembly joining member 10' is provided with a lower snapping web 26 arranged on the lower side of a tongue 29. The lower snapping web 26 is intended to interact with a recess 27 arranged on a lower cheek 28 arranged on the second vertical assembly joining members 10" so that two joined adjacent panels 1 are locked against each other in a horizontal direction. The lower cheek 28 forms a lower surface of a groove 30 in the second edge 2".

The joint between a first and a second edge 2' and 2" respectively of two joined panels 1 further comprises contact surfaces which are constituted by the lower snapping web 26 and recess 27, the tongue 29 and groove 30 as well as upper mating surfaces 25. The joint between two joined panels 1 also comprises cavities which are formed between the surfaces of the assembled joint. One special cavity is arranged between the upper mating surface 25 and the tongue 29 of the first assembly joining member 10' and is designed for holding a tube of encapsulated PVAC glue. Another special cavity is formed in the bottom of the groove 30 and also designed for holding a tube of encapsulated PVAC glue. The special cavities as well as the tip of the tongue 29 and the upper mating surface 25 of the second vertical assembly member 10", being closest to the special cavities when assembled, is designed to rupture the tubes of encapsulated glue 7 and force the glue towards the upper mating surfaces 25. The later may be further secured by having applied a foaming agent on the surface of the special cavity, or by using a polyurethane glue.

Figure 5:
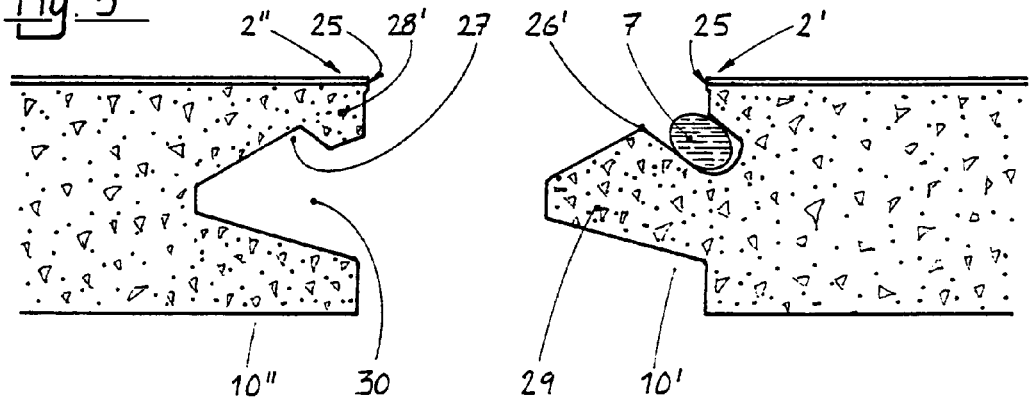
FIG. 5 shows a fifth embodiment of adjacent edges of two panels to be joined according to the present invention.

FIG. 5 shows, in cross-section, two adjacent edges according to a fifth embodiment of the invention. The panels 1 are provided with a first assembly joining member 10' on a first edge 2' while a second edge 2" is provided with a second assembly joining member 10". The second edge 2" is arranged on a side opposite to the first edge 2'. The first assembly joining member 10' is provided with an upper snapping web 26' arranged on the upper side of a tongue 29. The upper snapping web 26' is intended to interact with a recess 27 arranged on a upper cheek 28' arranged on the second vertical assembly joining members 10" so that two joined adjacent panels 1 are locked against each other in a horizontal direction. The upper cheek 28' forms an upper surface of a groove 30 in the second edge 2".

The joint between a first and a second edge 2' and 2" respectively of two joined panels 1 further comprises contact surfaces which are constituted by the upper snapping web 26' and recess 27, the tongue 29 and groove 30 as well as upper mating surfaces 25. The joint between two joined panels 1 also comprises cavities which are formed between the surfaces of the assembled joint. One special cavity is formed between the upper mating surface 25 and the tongue 29 of the first assembly joining member 10' and is designed for holding a tube of encapsulated PVAC glue. The special cavity as well as the opposite edge mating surface 25, being closest to the special cavity when assembled, is designed to rupture the tube of encapsulated glue 7. It is possible to further secure distribution of the glue by having applied a foaming agent on the surface of the special cavity, or by using a polyurethane glue with foaming agent. The tip of the tongue 29 is further provided with an angled upper surface intended to guide the glue to the upper portions o the joint.

Figure 6:
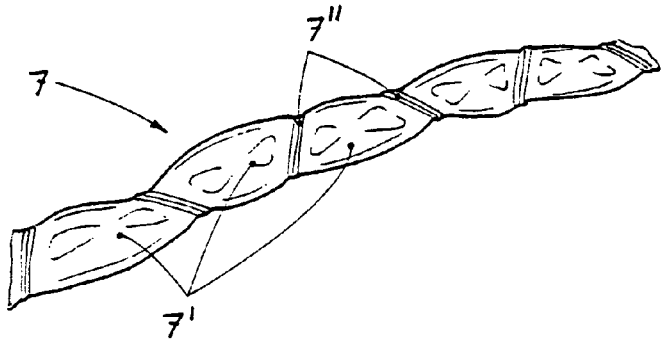
FIG. 6 shows a tube sectioned into a series of encapsulating confined bodies of agent.

FIG. 6 shows, schematically in perspective view a selected embodiment of a tube according to the invention. An encapsulated agent is present in the form of at least one tube 7 containing the agent. The tube 7 is sectioned into a series of confined bodies 7' of agent. This will ensure that enough of the agent is present to ensure a good bond when cutting panels 1 during installation, as such cutting, inevitably will rupture the tube 7. Since the tube 7 is sectioned, only one or at most two of the confined bodies 7' of agent will be ruptured, leaving enough of the confined bodies 7' of agent to ensure a good bond. The most important reason to have the tube 7 sectioned into confined bodies 7' of agent is however the importance of even distribution of the agent along the joint. If, for example, a single compartment tube 7 were to be used and the joint were assembled slowly, it would be possible that the full amount of the agent would leak out at one of its ends. This is, of course not desired. It is therefore advantageous to utilise a tube 7 which is sectioned. It is also advantageous to design the tube 7 in a way that it will rupture in a controlled manner during assembly. This is best performed by making the tube 7 of a strip material, most suitably a thermoplastic laminate. The materials of the laminate are selected so that the longitudinal bond of the tube 7 breaks before the latitudinal 7" bond. It will hereby be secured that each body 7' of agent will rupture during assembly. One way of achieving this is by making the tube 7 welded from a thermoplastic laminate strip where the long sides of the strip is overlapping so that an inside of the strip is welded towards an outside of the opposite long side of the strip thereby forming the tube 7. The material of the laminate is selected so that the inside is constituted of a first material and the outside is constituted by a second material wherein the first material will have a good bond when welded together with itself and wherein a second material have a bond to the first material which is weaker than the bond between two first materials.

The encapsulated agent may according to one embodiment of the invention be a glue, suitably of the PVAC glue type or a polyurethane glue type. The encapsulated agent may alternatively be a solvent used as an activator. A glue is then pre-applied on the edges as an emulsion which then is allowed to dry before the joining of the surface elements, whereby the agent is a solvent used for activating the dry glue during assembly. Both the pre-applied dry glue and the tube 7 containing the agent is advantageously applied during manufacturing to make the final assembly easier. The pre-applied dry glue is suitably a PVAC glue whereby the agent is water or a mixture of water and alcohol. The glue may further comprise an expanding agent causing the glue to swell when activated. This will ensure that the glue is distributed over desired surfaces of the joint. Such an expanding agent may be a cellulose derivative. It is also possible to an expanding agent which reacts with water or alcohol like for example calcium hydro carbonate or sodium hydro carbonate. This will cause the glue to foam.

the agent may according to an alternative embodiment of the invention be an encapsulated glue which is present in the form of pairs of tubes where a first tube 7 contains a first glue component of a two component glue system and where a second tube 7 contains a second component of the two component glue system. Also here the tubes 7 are preferably sectioned into a series of confined bodies 7' of glue of reasons as discussed above. It is also important that the two components are allowed to blend. It is therefore suitable to have them arranged in the same special cavity or in special cavities arranged close to one another.

When selecting material for the tube 7 as well as when selecting agent in the form of solvent one must take in consideration that the tube 7 should be easily ruptured and be able to prevent the contents from migrating through the walls of the encapsulation for at least 3 months.

The invention is not limited by the embodiments shown since these can be varied in different ways within the scope of the invention.

The invention claimed is:

1. A method of forming a planar surface, comprising:

providing a first panel, the first panel comprising:

a decorative upper surface and edges, at least one of said edges comprising a groove;

joining a second panel to the first panel, the second panel comprising a decorative upper surface and edges, at least one of said edges comprising a tongue;

whereby the joining comprises releasing an encapsulated agent disposed in a segmented tube between the tongue and the groove.

2. The method of claim 1, wherein the joining comprises relatively moving the first and second panel towards each other to join the groove of the first panel to the tongue of the second panel.

3. The method of claim 1, wherein the joining comprises:

inserting the tongue into the groove, to form an at least partially joined tongue-groove, and thereafter further moving the at least partially joined moving the at least partially joined tongue-groove to rupture at least a portion of the segmented tube.

4. The method of claim 1, wherein the encapsulated agent is a component of a multi-part glue.

5. The method of claim 4, wherein the joining further comprises contacting the encapsulated agent with a second component of a multi-part glue.

6. The method of claim 5, wherein the second component is encapsulated.

7. The method of claim 6, wherein the contacting comprises releasing the second component from a segmented tube.

8. The method of claim 1, wherein the releasing comprises rupturing a longitudinal bond of the tube.

9. A method of forming a planar surface, comprising: providing a first panel, the first panel comprising:

a decorative upper surface, and edges, at least one of said edges comprising a groove; joining a second panel to the first panel, the second panel comprising a decorative upper surface and edges, at least one of said edges comprising a tongue; whereby the joining comprises releasing an encapsulated agent from an encapsulation comprising a unitary structure, the structure comprising a plurality of compartments in which the agent is contained, the encapsulation being disposed in a cavity adjacent to the tongue.

10. The method of claim 9, wherein the joining comprises relatively moving the first and second panel towards eaach other.

11. The method of claim 9, wherein the joining comprises:

inserting the tongue into the groove to form an at least partially joined tongue-groove, and thereafter further moving the at least partially joined tongue-groove to rupture the encapsulated agent.

12. The method of claim 9, wherein the encapsulated agent is contained in a segmented tube.

13. The method of claim 11, wherein the encapsulated agent is contained in a segmented tube.

* * * * *